US006209634B1

(12) United States Patent
Avakov et al.

(10) Patent No.: US 6,209,634 B1
(45) Date of Patent: Apr. 3, 2001

(54) COILED TUBING INJECTOR APPARATUS

(75) Inventors: Vladimir A. Avakov, Duncan, OK (US); William D. Taliaferro, Desoto; Malcolm N. Council, Richardson, both of TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 08/638,272

(22) Filed: Apr. 26, 1996

(Under 37 CFR 1.47)

(51) Int. Cl.[7] ..... E21B 19/22
(52) U.S. Cl. ..... 166/77.3; 166/85.1
(58) Field of Search ..... 166/77.3, 85.1, 166/385; 242/83

(56) References Cited

U.S. PATENT DOCUMENTS

| | | | | |
|---|---|---|---|---|
| 4,145,014 | * | 3/1979 | Chatard et al. | 242/83 |
| 4,515,220 | | 5/1985 | Sizer et al. | 166/384 |
| 4,655,291 | | 4/1987 | Cox | 166/385 |
| 5,088,559 | | 2/1992 | Taliaferro | 166/379 |
| 5,094,340 | | 3/1992 | Avakov | 198/626.1 |
| 5,188,174 | | 2/1993 | Anderson, Jr. et al. | 166/77 |
| 5,234,053 | | 8/1993 | Connell | 166/250 |
| 5,244,046 | | 9/1993 | Council et al. | 166/380 |
| 5,279,364 | | 1/1994 | Jantzen et al. | 166/77 |
| 5,553,668 | * | 9/1996 | Council et al. | 166/77.3 |
| 5,850,874 | * | 12/1998 | Burge et al. | 166/77.3 |

OTHER PUBLICATIONS

Otis Engineering Corporation Products and Services Catalog, 1989, pp. 284–290.
Photographs 1, 2, 3, and 4 of a prior art apparatus.

* cited by examiner

*Primary Examiner*—William Neuder
(74) *Attorney, Agent, or Firm*—Robert A. Kent; Anthony L. Rahhal

(57) ABSTRACT

A coiled tubing injector apparatus for use in inserting coiled tubing into a well, temporarily suspending the coiled tubing, and removing the coiled tubing from the well is described. The apparatus includes a base with a pair of spaced carriages extending upwardly therefrom. The base is attached to a superstructure. The carriages each have a gripper chain drive system rotatably mounted thereon and movable therewith. An actuation and linkage system allows the carriages to move toward and away from one another in a lateral or transverse direction with respect to the superstructure and the base. Thus, the gripper chain systems can be engaged or disengaged from tubing extending through the apparatus. Each of the carriages are pivotally attached to the base with a load pin which extends through lugs attached to the base and corresponding lugs extending down from the carriage.

21 Claims, 10 Drawing Sheets

COILED TUBING INJECTOR APPARATUS

BACKGROUND OF THE INVENTION

After a well has been completed to produce oil or gas, it is necessary to periodically service the well. There are many occasions where the service procedure is carried out using coiled tubing. Such tubing is inserted into the wellhead through a lubricator assembly or stuffing box. Typically, this is necessary because there is a pressure differential at the surface of the well and the atmosphere, which may have been naturally or artificially created, that serves to produce oil or gas or a mixture thereof from the pressurized well. The tubing that is inserted into the well is normally inserted through a lubricator mechanism which provides a seal about the O.D. of the tubing for the retention of any pressure that may be present at or near the surface of the well. The tubing is inserted by a coiled tubing injector apparatus which generally incorporates a multitude of gripper blocks for handling the tubing as it passes through the injector. The tubing is flexible and can therefore be cyclically coiled onto and off of a spool, or reel, by the injector which often acts in concert with a windlass and a power supply which drives the spool, or reel.

The coiled tubing injector apparatus utilizes a pair of opposed endless drive chains which are arranged in a common plane. These opposed endless drive chains are often referred to as gripper chains because each chain has a multitude of gripper blocks attached therealong. The gripper chains are driven by respective drive sprockets which are in turn powered by a reversible hydraulic motor. Each gripper chain is also provided with a respective idler sprocket to maintain each gripper chain within the common plane. Both the drive sprockets and idler sprockets are mounted on a common frame wherein the distance between centers of all the sprockets are essentially of a constant distance from each other. That is, the drive sprockets are free to rotate but are not free to move either vertically or laterally with respect to each other. The idler sprockets are not free to move laterally with respect to each other, but are vertically adjustable within a limited amount in order to set the amount of play in each gripper chain. Such vertical adjustment is done by either a mechanical adjusting means or a hydraulic adjusting means. Typically, for injectors having mechanical adjustment means, the adjustment is made when the injector is not in operation.

The opposed gripper chains, preferably via the gripper blocks, sequentially grasp the coiled tubing that is positioned between the opposed gripper chains. When the gripper chains are in motion, each chain has a gripper block that is coming into contact with the coiled tubing as another gripper block on the same gripper chain is breaking contact with the coiled tubing. This continues in an endless fashion as the gripper chains are driven to force the tubing into or out of the wellbore, depending on the direction in which the drive sprockets are rotated. Preferably, gripper blocks such as those set forth in U.S. Pat. No. 5,094,340, issued Mar. 10, 1992, to Avakov, which is incorporated herein, are used.

Because the gripper chain drive sprockets and idler sprockets are essentially in a fixed relationship with each other, the gripper chain is provided with a predetermined amount of slack which allows the gripper chain to be biased against the coiled tubing to inject the tubing into and out of the wellbore. This biasing is accomplished with an endless roller chain disposed inside each gripper chain. Each roller chain engages sprockets rotatably mounted on a respective linear bearing beam. A linkage and hydraulic cylinder mechanism allows the linear bearing beams to be moved toward one another so that each roller chain is moved against its corresponding gripper chain such that the tubing facing portion of gripper chain is moved toward the tubing so that the gripper blocks can engage the tubing and move it through the apparatus. The gripper blocks will engage the tubing along a working length of the linear beam.

Each chain has a gripper block that contacts the tubing at the top of the working length as a gripper block on the same chain is breaking contact at a bottom of the working length of the linear beam.

The fixed distance between each set of gripper chain drives and idler sprockets requires some significant lateral movement in the gripper chain when engaged by the roller chain on the corresponding linear beam in order to allow the gripper chains to engage the tubing by way of the gripper blocks. The reason for having the requisite amount of lateral play in the gripper chains is to provide a limited amount of clearance between the gripper chains, upon moving the respective roller chains away from the vertical center line of the injector, to allow the passage of tubing and tools having larger outside diameters or dimensions. An inherent shortcoming in this design is that the required slack can often cause misalignment problems and even binding problems with the chains due to having to accommodate ever increasing outside nominal dimensions of downhole tools and wellhead equipment. Another troublesome characteristic manifests itself in the large approach and departure angles defined by the region where the respective paths of the gripper chains converge upon, and diverge away from, the working center line of the injector wherein the coiled tubing is preferably positioned for being injected or extracted into or out of the well. The large approach and departure angles reduce the overall efficiency of the injector due to the necessity of supporting and contending with the reactive forces generated by the chains when the injector is in operation.

A further, if not more predominate reason why large gripper chain approach and departure angles are not desired, is that large angles tend to increase the likelihood of the chain-mounted gripper blocks to mark, or gouge, the tubing as the blocks come into contact with the tubing. Such marks, or gouges, create stress risers within the wall of the tubing which can lead to premature structural failure of the tubing. A tubing injector apparatus not having large gripper chain approach or departure angles, yet being able to accommodate large diameter tubing and wellhead equipment would advance the art considerably.

Therefore, there is a need within the art to provide an injector that, while the injector remains installed about the wellhead, can accommodate large nominal diameter tools and surface equipment, yet can provide efficient and reliable chain operation to generate the high forces needed for injecting and extracting tubing of long lengths and large diameters into and out of the wellbore.

Another need within the art is for an injector having the ability to accommodate a wide range of tubing diameters while in operation. Such an injector would allow for improving operations wherein coiled tubing having differing diameters that have been connected to each other to form a single string of tubing are being used in the servicing of the well.

Another need within the art is for an injector that can accommodate the ever-increasing nominal outside diameters of tubing while avoiding: chain misalignment, chain binding tendencies, improper chain tension, gripper block marking or gouging, and other inherent design problems of prior injectors which manifest themselves when working with tubing, tools, and surface equipment having large nominal outside diameters.

One coiled tubing injector apparatus which resolves the foregoing problems is the apparatus described in patent application Ser. No. 08/508,411 entitled TWIN CARRIAGE TUBING INJECTOR APPARATUS, assigned to the assignee of the present invention, the details of which are incorporated herein by reference. However, the apparatus described therein, along with prior injectors, do not address other difficulties associated with injecting, suspending and extracting coiled tubing from a wellbore.

Generally, as provided herein, the wellbore in which the tubing is injected will be pressurized, so that as the tubing is initially inserted through the injector and into the wellbore, the pressure will tend to resist injection of the tubing. In other words, when the length of tubing in the well is such that it is insufficient to overcome the pressure in the wellbore, the pressure will tend to resist injection and will act to force the tubing upward. At some point, the weight of the tubing will overcome the pressure in the wellbore. The weight of the tubing will then apply a downward vertical load to the gripper blocks that engage the tubing. The downward load is typically called a "hoisting" load.

When the gripper chains are in motion, the gripper blocks along the working length of the linear beam engage the tubing. The lateral load applied to the tubing by the opposed gripper chains will generally be uniform along the working length of the linear beam. The vertical hoisting load is carried by linking pins which connect the gripper blocks together to form the endless gripper chains. Because the lateral load applied to the tubing is substantially uniform, the vertical load applied to the gripper chain by the tubing will be carried primarily by the linking pins which connect the gripper blocks at the lower or bottom end of the working length of the linear beam. The linking pins connecting the remainder of the blocks carry little or no vertical load. Because the vertical load during hoisting is concentrated on the lower linking pins, the life of the chain is reduced.

Thus, there is a need for a coiled tubing injector apparatus which will accommodate large nominal diameter tools and tools of differing diameters while in operation, and at the same time redistribute the vertical load created by the tubing from the linking pins at the bottom of the working length to all of the pins along the working length of the linear beam and the corresponding working length of the gripper chain.

SUMMARY OF THE INVENTION

The present invention is a coiled tubing injector apparatus for use in inserting coiled tubing into a well, temporarily suspending the tubing in the well, and for extracting coiled tubing from the well. The apparatus generally comprises a base, a carriage extending upward from the base, and a gripper chain drive system mounted in the carriage. The base is connected to a superstructure which is mounted above a wellhead.

The carriage is pivotally attached to the base, and is preferably laterally movable with respect to the base. The gripper chain drive system is movable with the carriage, and is adapted to engage tubing extending through the superstructure. The carriage is preferably one of a pair of spaced carriages which are pivotally attached to and laterally movable with respect to the base. The tubing will pass between the spaced carriages and through the base along a preselected center line, so that the tubing will pass between and be engaged by the gripper chain drive systems when the carriages are moved toward one another.

The base has a pair of attachment lugs extending upwardly therefrom. The attachment lugs will mate with corresponding carriage lugs located at a lower end of the carriages. The carriages are attached to the base with a load pin extending through the attachment lugs and corresponding carriage lugs. The attachment lugs are slidably connected to the base, so that the carriages are laterally movable with respect to the base and each other.

The gripper chain drive system comprises a drive shaft mounted on the carriage, drive sprockets mounted on the drive shaft, an idler shaft mounted on the carriage and idler sprockets mounted on the idler shaft. A gripper chain which includes a plurality of gripper blocks attached thereto engages the drive and idler sprockets.

A roller chain system for supporting the gripper chain when it engages the tubing is also included. The roller chain system is mounted on a pressure, or linear beam that is rigidly positioned in the carriage. The roller chain system includes an upper mounting shaft mounted on the linear beam, an upper roller sprocket mounted on the upper mounting shaft, a lower mounting shaft mounted on the linear beam, a lower roller sprocket located on the lower mounting shaft, and a roller chain engaged with the upper and lower roller sprockets. Each linear beam has a working length defined thereon to support the gripper chain. When the carriages are moved so that the gripper chains engage the coiled tubing, the chain will engage the tubing along the working length of the linear beam, and a corresponding working length of the gripper chain.

The apparatus includes a means for moving the carriages laterally, which may comprise a plurality of hydraulically actuated gripper cylinders. When the gripper cylinders are actuated to move the carriages toward one another so that the gripper chain will engage the tubing, a lateral, or transverse load is applied to the tubing by the gripper chains. The lateral load applied by the gripper cylinders is typically distributed uniformly along the working length of the linear beam. When the weight of the tubing in the wellbore causes a downward load to be applied to the gripper chain, a moment around the load pins is created. That moment is reacted by a lateral force between the tubing and the gripper chains. The moment is reacted so that the total lateral load at the top of the working length, which is comprised of the load applied by the gripper cylinder and the reaction load caused by the moment around the load pin, is higher than the lateral load at the bottom of the working length. The lateral load gradually decreases from its highest magnitude at the top to its lowest magnitude at the bottom of the working length of the linear beam. Because the lateral load is higher at the top of the working length, the vertical load caused by the tubing in the wellbore will be more evenly distributed along the working length of the gripper chain than it would be if the lateral load were uniform. The vertical, or hoisting load will therefore be carried by the linking pins which connect the links of the gripper chain along the entire working length of the linear beam. The apparatus thus equalizes the hoist load so that it is carried by all of gripper blocks along the working length of the gripper chain. With prior art injectors, the hoisting load was carried primarily by the gripper blocks, and thus by the linking pins connecting the gripper blocks, at the lower end of the working length.

Numerous objects and advantages will become apparent as the detailed description of the preferred embodiment is read in conjunction with the drawings which illustrate such embodiment.

BRIEF DESCRIPTION OF THE DRAWINGS

FIG. 6 shows a view from line 6—6 in FIG. 3.

DESCRIPTION OF THE PREFERRED EMBODIMENT

Figure 1:
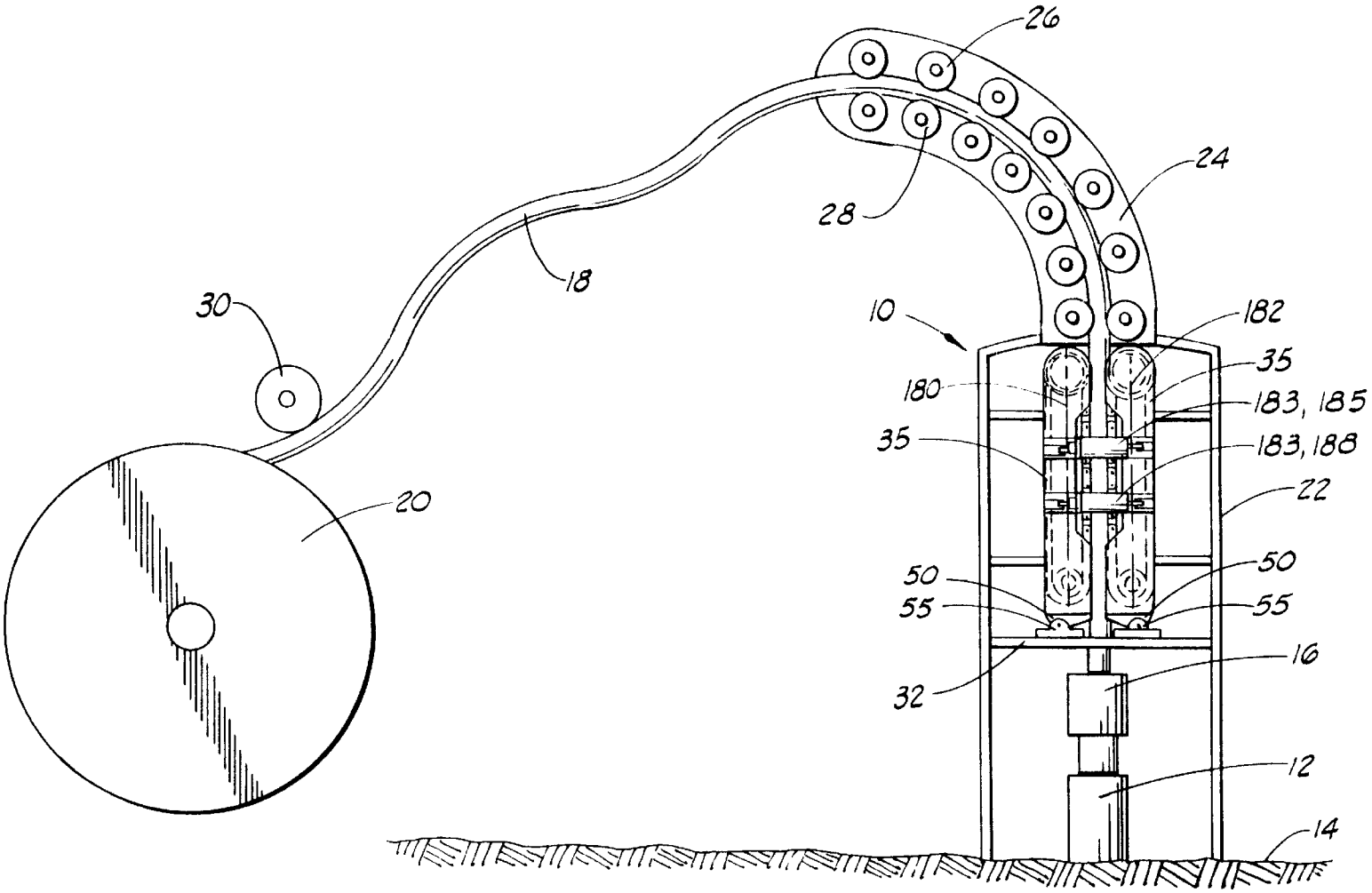
FIG. 1 schematically shows the load equalizing coiled tubing injector apparatus of the present invention in position for inserting coiled tubing into an adjacent wellhead.
Figure 3:
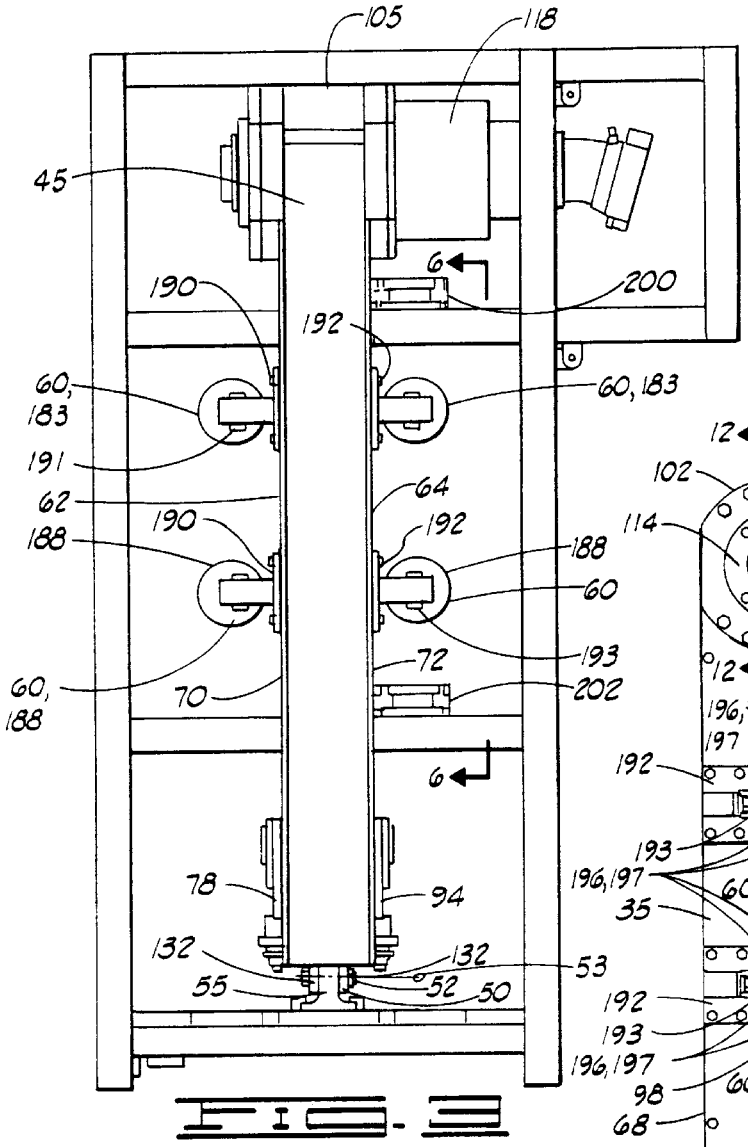
FIG. 3 shows a side view of the apparatus of the present invention.

Referring now to the drawings, and more particularly to FIG. 1, the coiled tubing injector apparatus of the present invention is shown and generally designated by the numeral 10. Injector 10 is shown positioned above a wellhead 12 at a ground surface or subsea floor 14. A lubricator or stuffing box 16 is connected to the upper end of wellhead 12.

Tubing 18, having a longitudinal central axis 17 and an outer diameter or outer surface 19 is supplied on a large drum or reel 20 and is typically several thousand feet in length. Tubing of sufficient length, such as 10,000 feet or greater, may be inserted into the well either as single tubing, or as tubing spliced by connectors or by welding. The outer diameters of the tubing can range from approximately one inch (2.5 cm) to approximately five inches (12.5 cm). However, the disclosed injector apparatus is readily adaptable to even larger diameters. Typically, tubing 18 is in a relaxed but coiled state when supplied from drum 20. It is spooled from the drum typically supported on a truck (not shown) for mobile operations.

Injector apparatus 10 is mounted above wellhead 12 on a superstructure 22. Extending upwardly from superstructure 22 is a guide framework 24 having a plurality of pairs of guide rollers 26 and 28 rotatably mounted thereon.

Tubing 18 is supplied from drum 20 and is run between rollers 26 and 28. As tubing 18 is unspooled from drum 20, generally it will pass adjacent to a measuring device, such as wheel 30. Alternatively, the measuring device may be incorporated in apparatus 10, such as described in U.S. Pat. No. 5,234,053, issued Aug. 10, 1993, to Connell.

Rollers 26 and 28 define a pathway for tubing 18 so that the curvature in the tubing is slowly straightened as it enters apparatus 10. As will be understood, tubing 18 is preferably formed of a material which is sufficiently flexible and ductile that it can be curved for storage on drum 20 and also later straightened. While the material is flexible and ductile, and will accept bending around a radius of curvature, it runs the risk of being pinched or suffer from premature fatigue failure should the curvature be severe. Rollers 26 and 28 are spaced such that straightening of the tubing is accomplished wherein the tubing is inserted into the well without kinks or undue bending on the tubing. However, the disclosed injector can be used for injecting, suspending, or extracting any generally elongated body. All of this is done in a manner known in the art.

Referring now to FIGS. 2–18, the details of coiled tubing injector apparatus 10 will be discussed. The apparatus generally comprises a base 32 and a pair of substantially similar carriages 35 extending upward therefrom. Each carriage 35 includes a pair of spaced outer plates and a back plate. Each carriage has a carriage lug 50 extending downward from a lower end thereof. The carriage lugs 50 mate with a pair of attachment lugs 55 which extend upwardly from base 32 and which are slidable relative thereto as explained more fully herein. Attachment lugs 55 may include a lug base 56 having upper and lower surfaces 57 and 58, respectively, and an attachment portion 59 extending upward therefrom. A load pin 52, having a center or longitudinal central axis 53, extends through each carriage lug and the corresponding attachment lug, so that the carriages are pivotally attached to the base 32. The apparatus also includes a means 60 for moving the carriages laterally with respect to one another and with respect to the base 32. The apparatus 10 has a front, or forward side 62, and a back, or rear side 64.

Figure 2:
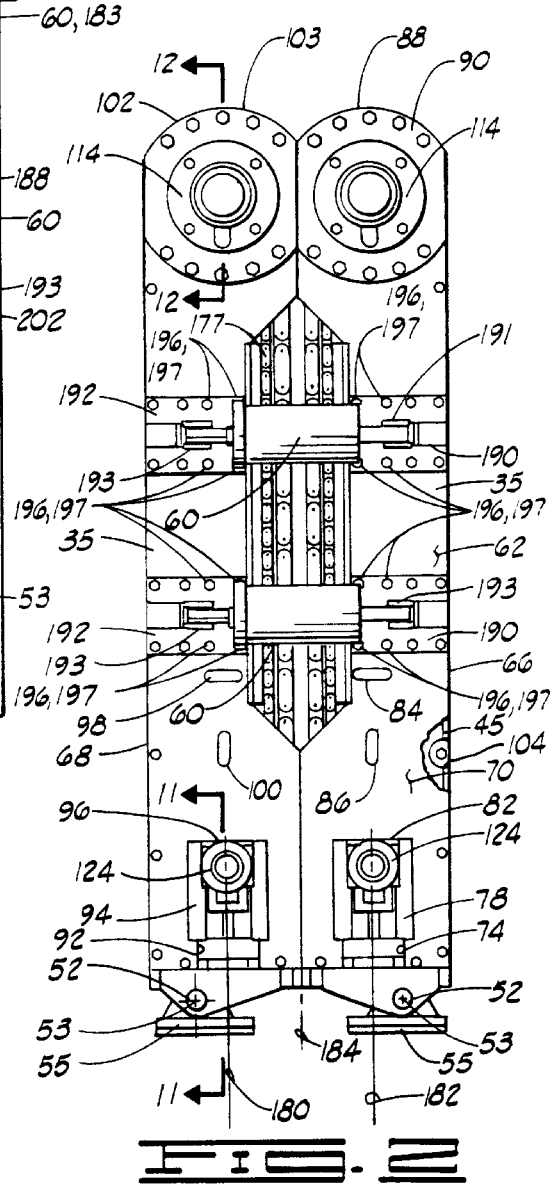
FIG. 2 shows a front view of the apparatus of the present invention.

The spaced carriages 35 comprise a first or right side carriage 66 and a second or left side carriage 68. Carriages 66 and 68 will move towards and away from each other when actuating means, or means for moving 60 is actuated. The carriages are substantially similar in that, as seen in FIG. 2, the carriages are mirror images of one another. Right side carriage 66 comprises first outer plate 70 and second outer plate 72. Plates 70 and 72 are mirror images of one another. First outer plate 70 may include rectangular cutout 74 at a lower end 76 thereof. A pair of bosses 78 extend downward from the top 82 of rectangular cutout 74. First outer plate 70 also includes horizontal and vertical access slots 84 and 86, respectively. The first outer plate 70 also has a stepped mounting boss 88 at an upper end 90 thereof.

Mounting boss 88 has steps 87 and 89 defined thereon. Second outer plate 72, being a mirror image of plate 70 likewise includes a rectangular opening 92 at a lower end 91 thereof, a pair of bosses extending downwardly from a top 96 of opening 92, horizontal and vertical access openings 98 and 100, respectively. Outer plate 72 has an upper mounting boss 102 having steps 99 and 101 at an upper end 103 thereof. First outer plate 70 is the forward outer plate of right side carraige 66 and second outer plate 72 is the rear outer plate. Because plates 70 and 72 are mirror images, and because right and left side carriages 66 and 68 are mirror images, the forward outer plate of left side carriage 68 is substantially identical to, and may be comprised of second outer plate 72, which is the rear outer plate on the right side carriage. Likewise, the rear outer plate on carriage 68 is substantially identical to and may be comprised of first outer plate 70. A back plate 45 is connected to outer plates 70 and 72. Right and left side carriages may also include upper caps 105 and 107 respectively disposed between the upper ends of the outer plates. Back plate 45 may be connected using bolts or other means known in the art. For instance, as shown in FIG. 2, the back plate may have lugs 104 extending inwardly therefrom so that bolts extending through the side plates may be attached thereto.

Figure 4:
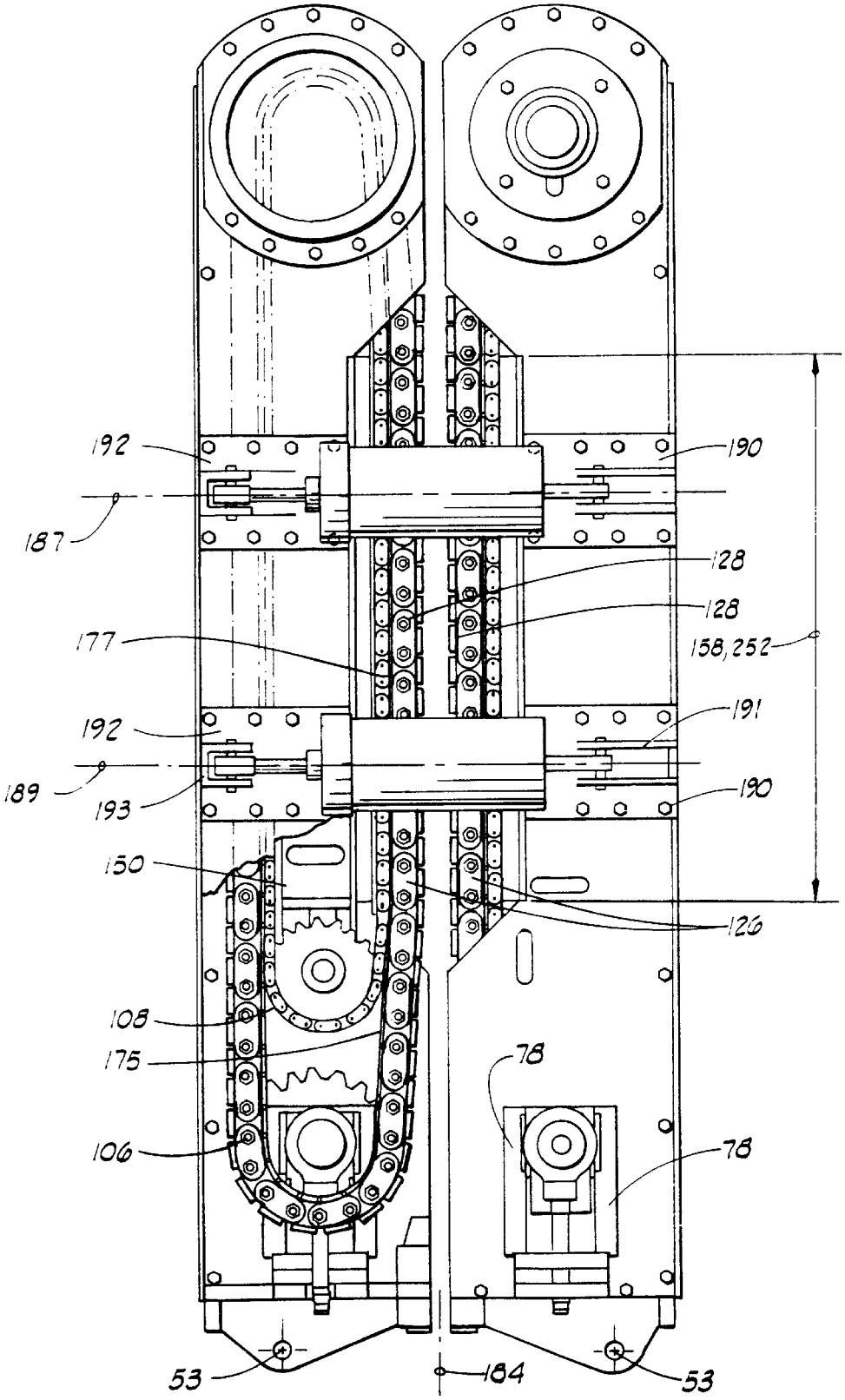
FIG. 4 shows a partial front view and a partial cross section of the carriages with a portion of the outer plate removed.
Figure 5:
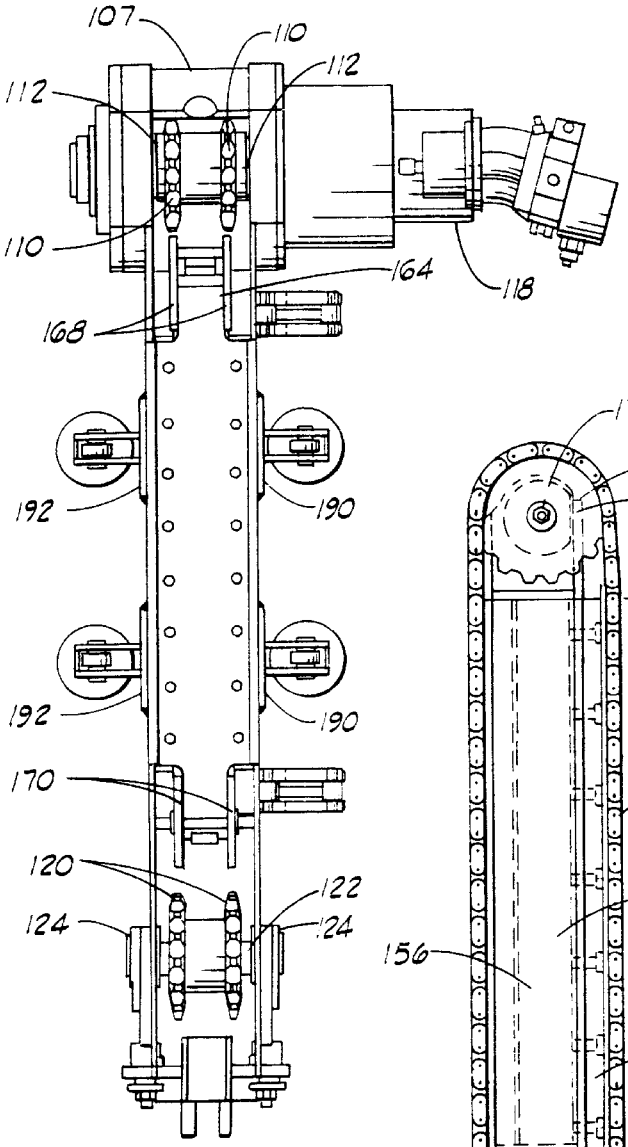
FIG. 5 shows a partial schematic looking at the inner side of a carriage from the center of the apparatus with the gripper and roller chains removed.

Each carriage also includes a gripper chain drive system 106 and a roller chain drive system 108. Referring to FIGS. 4 and 5, the gripper chain drive system includes a pair of spaced pair gripper chain drive sprockets 110 rotatably disposed in the carriage. Sprockets 110 are mounted on a shaft 112 having a center, or longitudinal central axis 113. As better seen in FIG. 12 shaft 112 extends through the upper mounting boss on the forward side of the apparatus and into to a flanged bearing 114. A bearing adapter 116 is also included and is attached to the upper mounting boss. The gripper chain drive sprockets are driven by a reversible hydraulic motor 118 attached to each carriage on the back side 64 of the apparatus. The motor is of a type known in the art and is driven by a planetary gear and has an integral brake. Thus, the hydraulic motor can inject, retract or suspend tubing 18 in a well.

Figure 11:
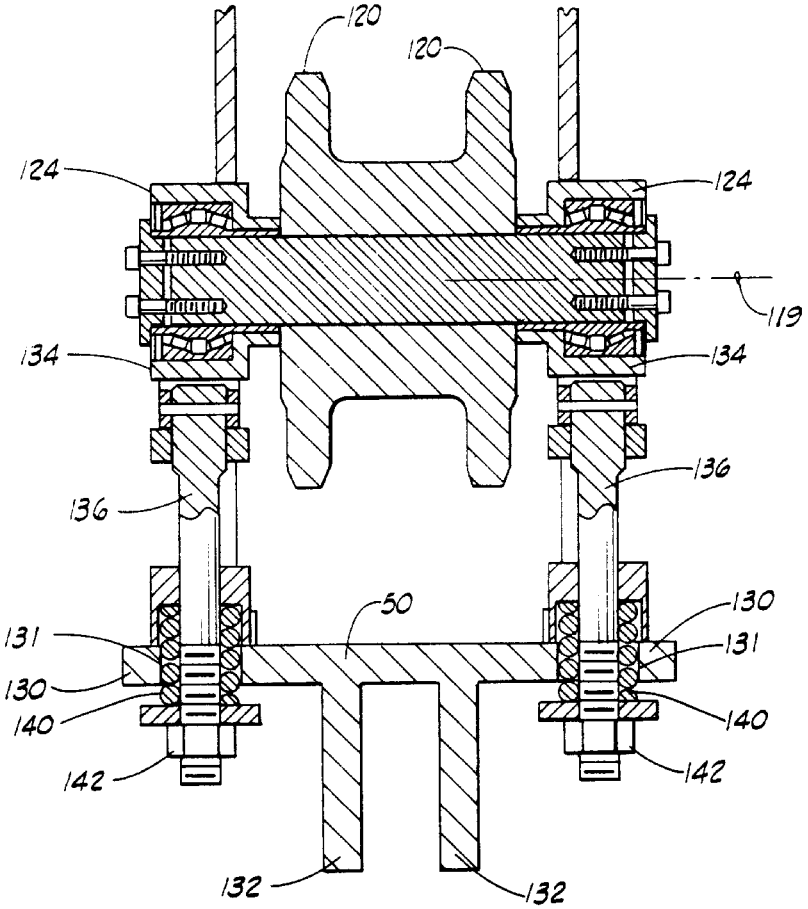
FIGS. 11 and 12 show section views taken from lines 11—11 and 12—12,respectively, on FIG. 2.
Figure 12:
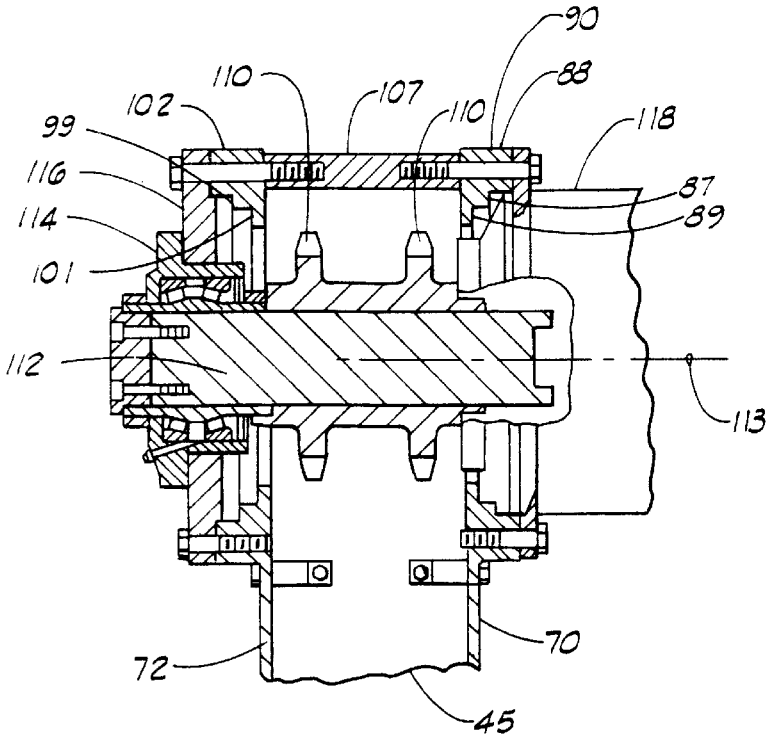

The gripper chain drive system also includes a pair of spaced gripper chain idler sprockets 120 which are rotatably disposed in the lower end of the carriage. The idler sprockets are mounted on a shaft 122 having a center, or longitudinal central axis 119. As best seen in FIG. 11, gripper chain tensioners 124 are connected to the opposite ends of shaft 122. Tensioners 124 are mounted on bosses 78 of first outer plate 70 and bosses 94 of second outer plate 72. Tensioners 124 are mounted so that they can be vertically adjusted within rectangular openings 74 and 92 of the outer plates, respectively. A gripper chain 126 is engaged with gripper chain drive sprockets 110 and the gripper chain idler sprockets 120 in each carriage. Gripper chain 126 is of a kind known in the art and has a plurality of outwardly facing gripper blocks 128 disposed thereon.

Gripper blocks 128 are adapted for engaging coiled tubing 18 and moving it through apparatus 10. Preferably gripper blocks 128 are such as those set forth in U.S. Pat. No. 5,094,340 issued Mar. 10, 1992, to Avakov. When actuating means 60 is actuated to move the carriage together, a gripping force is applied to the tubing by the gripper blocks.

Figure 17:
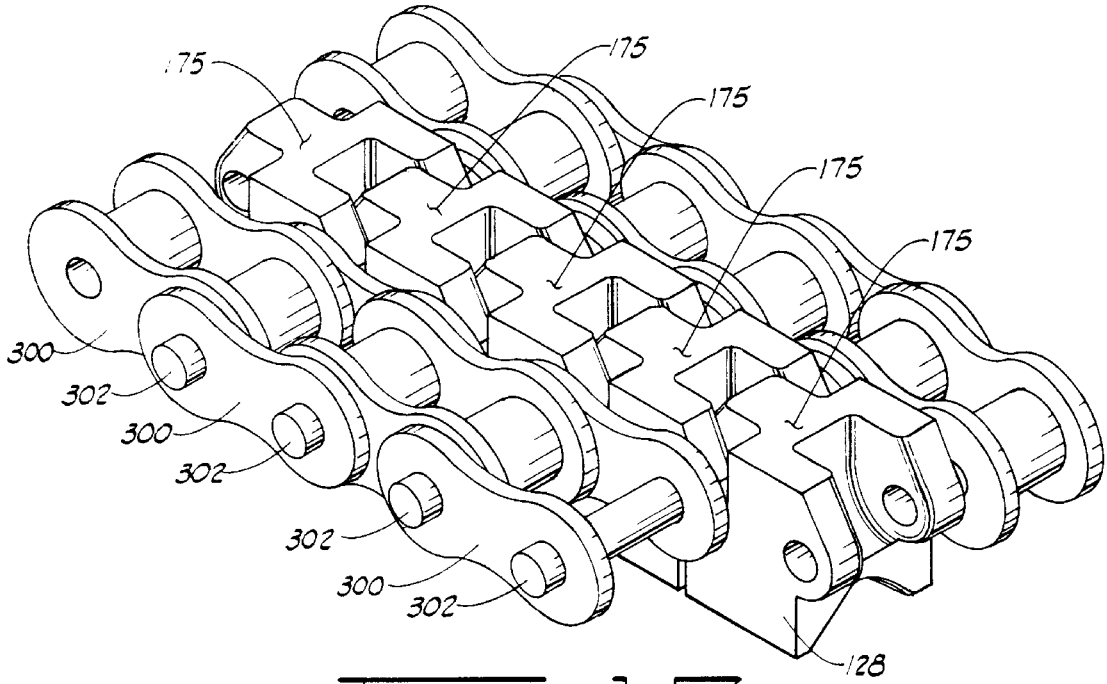
FIGS. 17 and 17A show perspective views of a portion of the chain of the present invention.
Figure 17A:
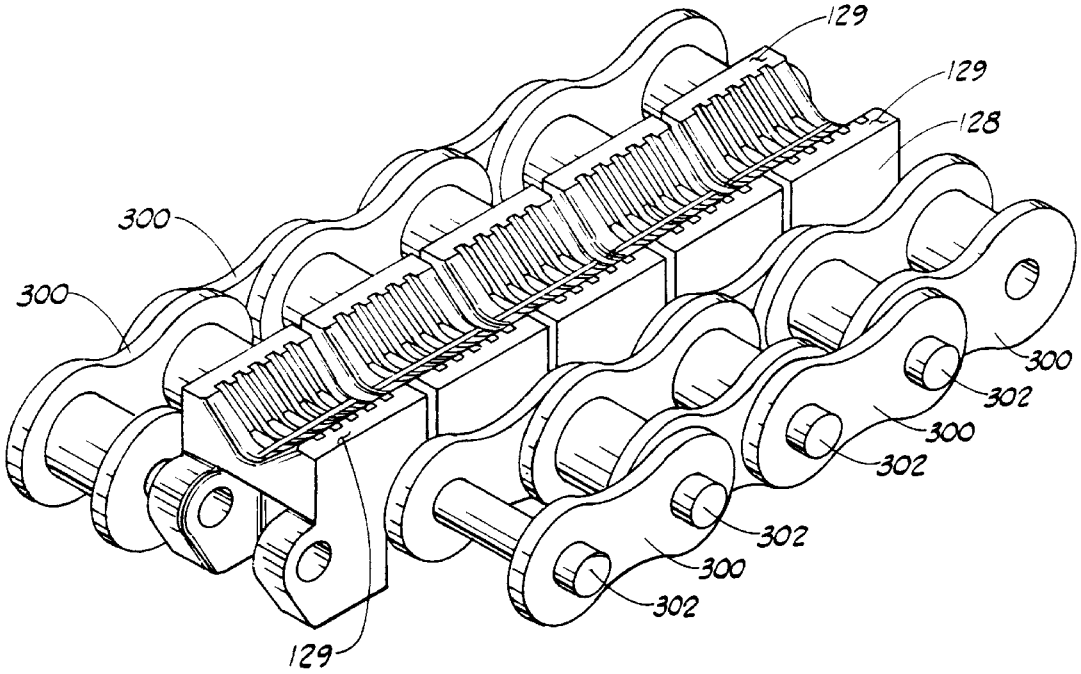
Figure 18:
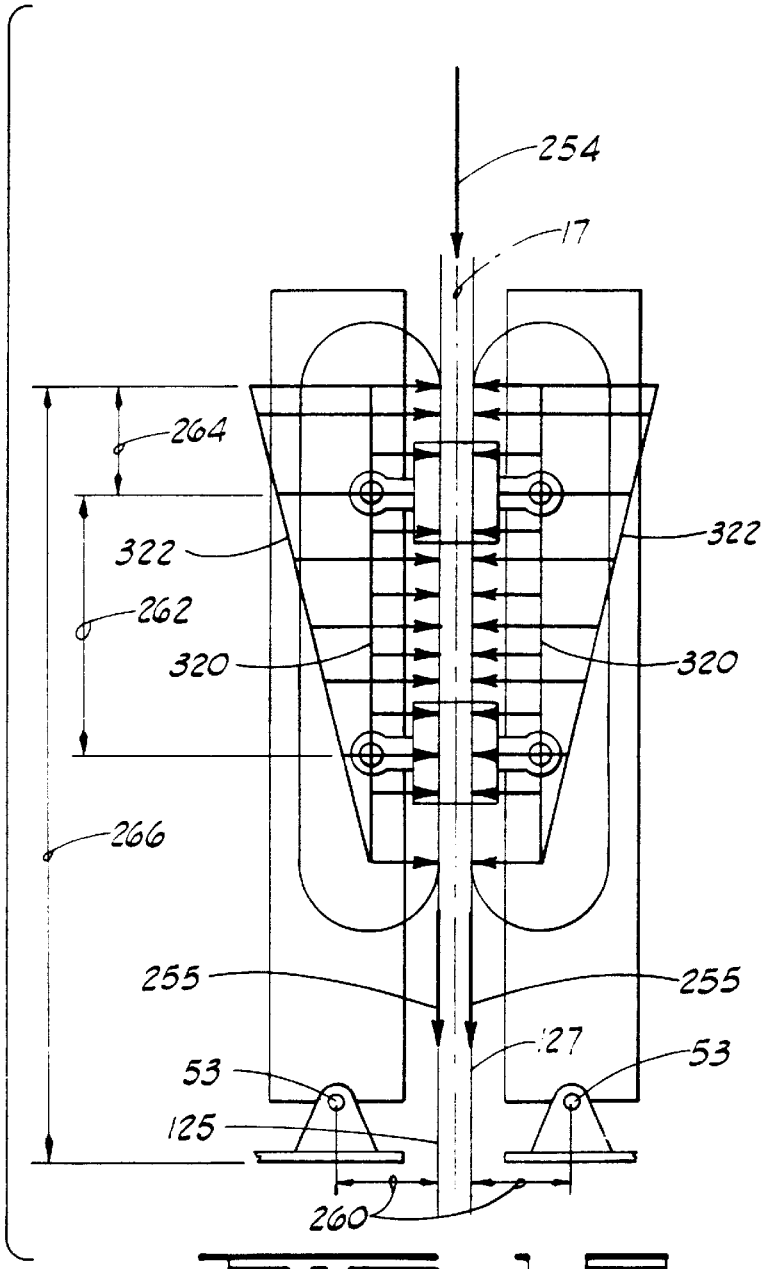
FIG. 18 schematically shows the loads applied when the present invention is in use.
Figure 19:
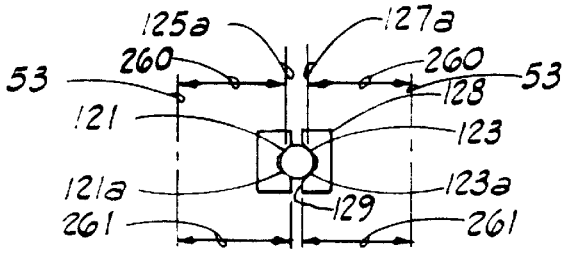
FIG. 19 schematically shows the top view of the gripper blocks and tubing when engaged.

As schematically shown in FIG. 17A, gripper blocks 128 have an inner face 129. The gripper blocks will contact outer diameter 19 of tubing 18 on both sides of center line 17. When gripper blocks having a V-shaped groove are used, such as those described in U.S. Pat. 5,094,340 to Avakov, the gripping forces are applied at contact points 121, 121*a*, 123 and 123*a* as seen in FIGS. 18 and 19. As shown therein, points 121 and 121*a* rest on the plane defined by line 125 in FIG. 18 and line 125*a* in FIG. 19. Likewise, points 123 and 123*a* rest on the plane defined by line 127 in FIG. 18 and line 127*a* in FIG. 19.

Figure 15:
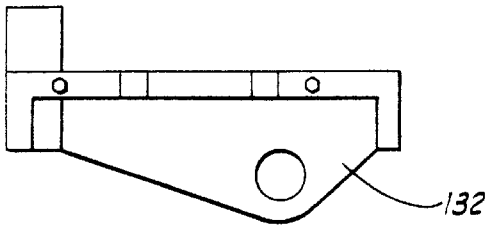
FIGS. 15 and 16 show detailed views of the carriage lug of the present invention.
Figure 16:
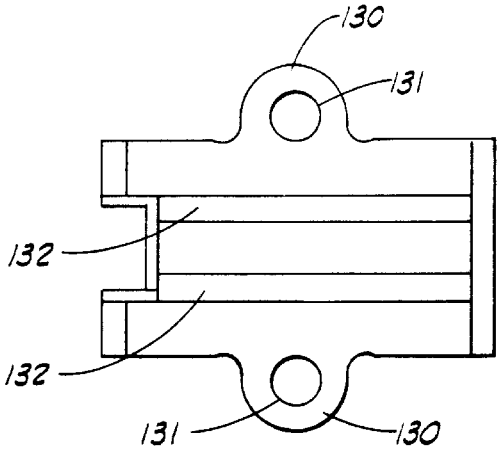

As set forth herein, a carriage lug 50 is rigidly mounted to and extends downwardly from the lower end of each carriage. As shown in FIGS. 15 and 16, each carriage lug has a pair of ears 130 extending outwardly therefrom. Ears 130 have openings 131 defined therein. Carriage lug 50 also includes a pair of spaced carriage mounting lugs 132.

Gripper chain tensioners 124 are vertically adjustable within the lower rectangular openings of the outer plates so that the proper tension on gripper chain 126 may be maintained. Tensioner 124 includes a bearing portion 134 and has a tensioning shaft 136 mounted to and extending downwardly from bearing portion 134. Idler shafts 122 are mounted in bearing portion 134. Tensioning shafts 136 extend through openings 131 in the pair of ears 130 on carriage lug 50. A spring 140 is disposed around the shaft 138. The tension in gripper chain 126 can be adjusted simply by rotating a nut 142 on the threaded end of shaft 136.

Figure 7:
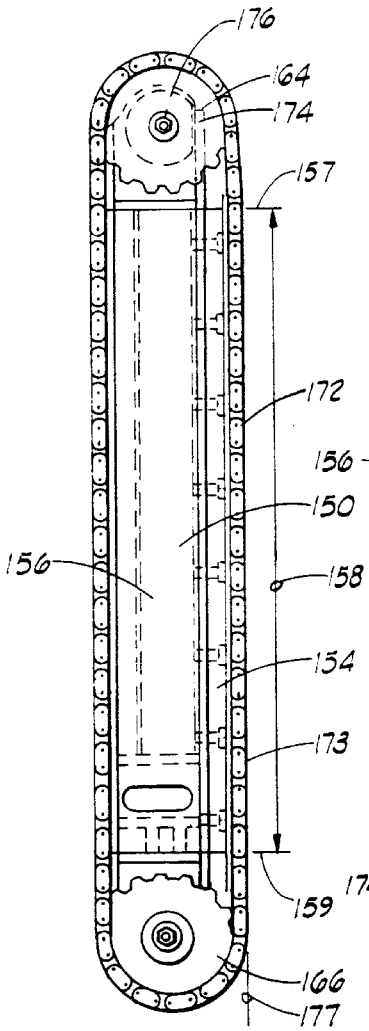
FIG. 7 shows a view of the linear beam.
Figure 8:
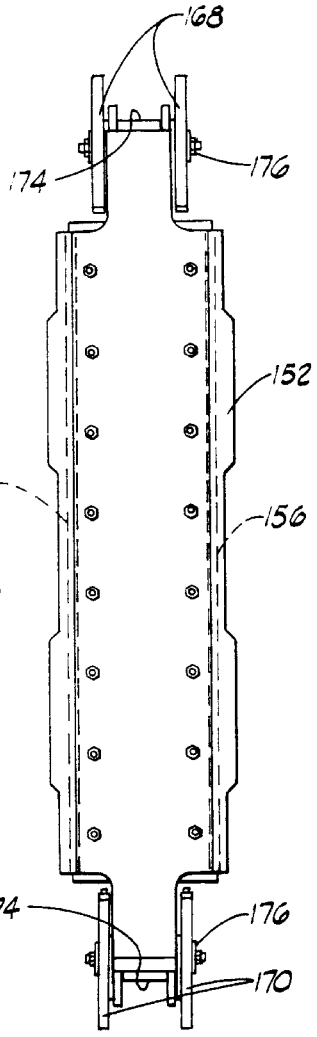
FIG. 8 shows the working face of the linear beam without the roller chain.
Figure 8:
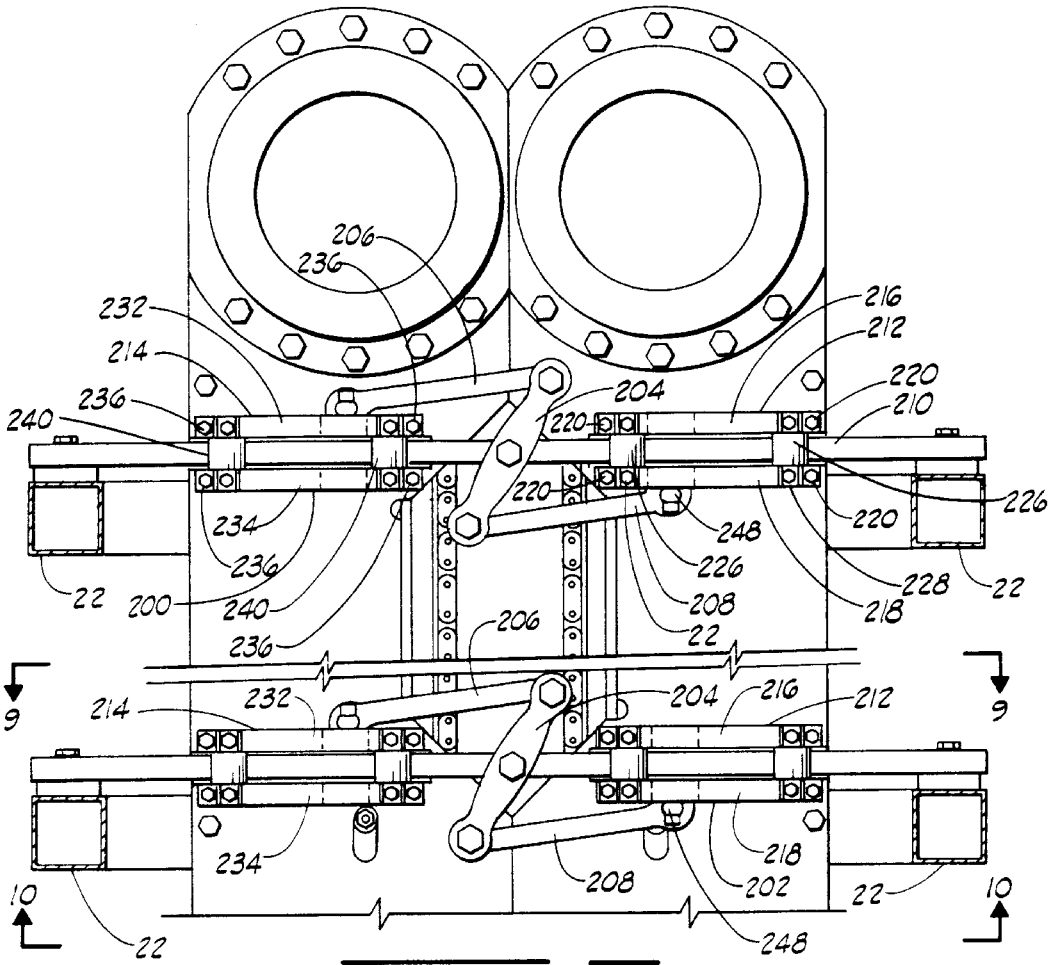

The roller chain drive system 108 is rigidly positioned in each carriage between the outer plates. Roller chain drive system 108 includes a linear or pressure beam 150 rigidly fixed to the outer plates of the carriage. The linear beam is shown in FIGS. 7 and 8. Linear beam 150 may be comprised of a linear beam frame 152 with a bearing plate 154 attached thereto. Linear beam frame 152 has side webs 156 which will nest between the outer plates of the carriages. The linear beam may be rigidly attached to the carriage with bolts extending through outer plates 70 and 72 and side webs 156. A working length 158 is defined on the linear beam. Working length 158 has upper and lower ends 157 and 159, respectively. The working length 158 corresponds to the flat portion of bearing plate 154. The linear beam has upper and lower ends 164 and 166 respectively. A pair of spaced upper, or first roller chain sprockets 168 are rotatably disposed on upper end 164 of linear beam 150. A pair of spaced lower, or second roller chain sprockets 170 are rotatably disposed on lower end 166 of the linear beam. A roller chain 172 engages upper and lower roller chain sprockets 168 and 170, respectively. Roller chain 172 has an outer side 173 which will engage an inner side 175 of gripper chain 126 along a line generally indicated by the numeral 177. The upper and lower sprockets may be mounted on bearings 174 supported by shafts 176. Lower sprockets 170 incorporate a tensioner (not shown), of a type known in the art to keep the proper tension on roller chain 172.

Figure 13:
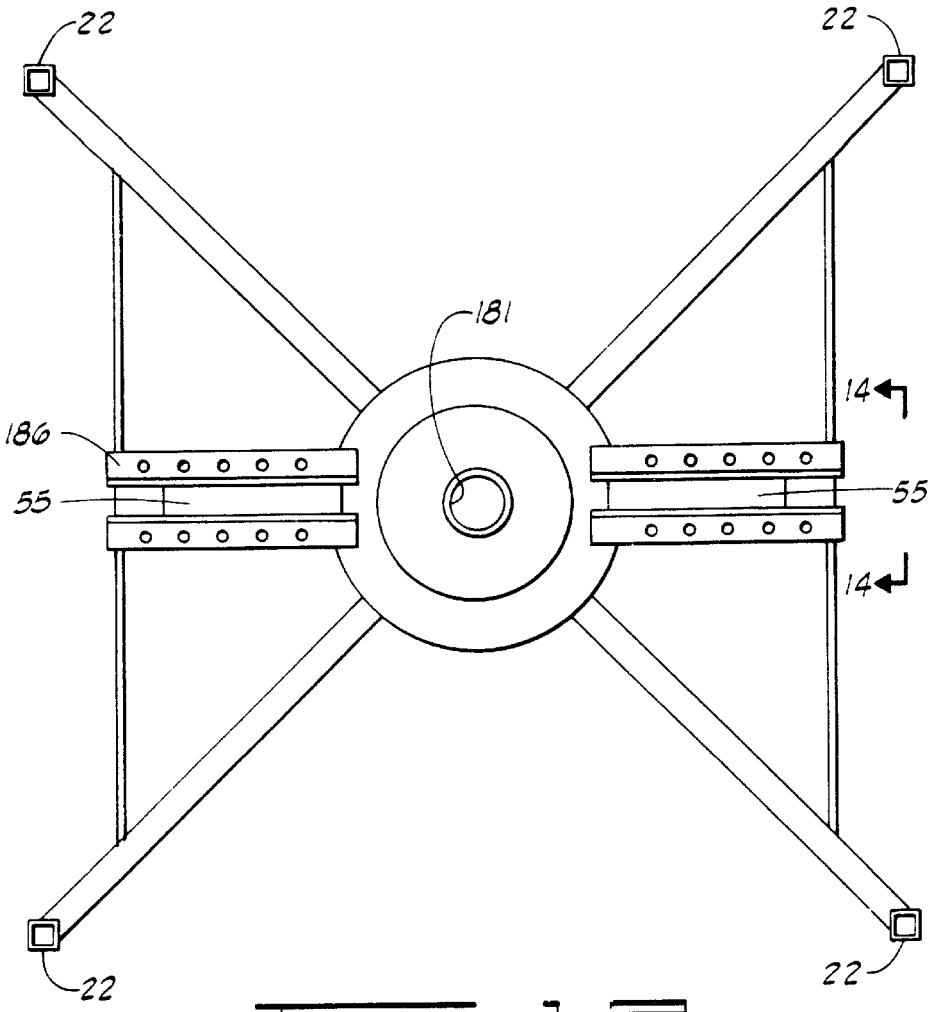
FIG. 13 schematically shows the base of the present invention.
Figure 14:
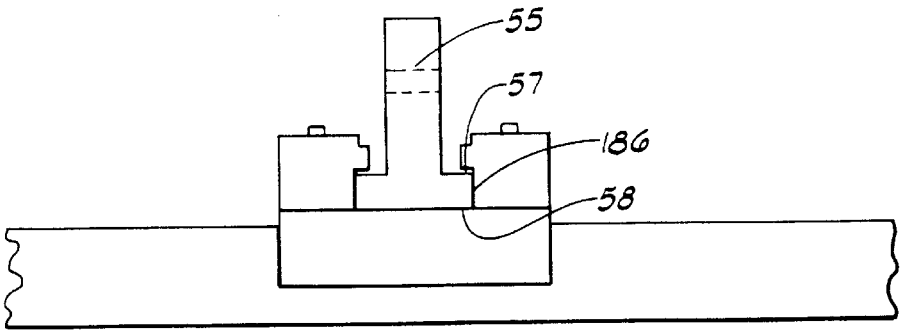
FIG. 14 shows a view taken from line 14—14 of FIG. 13.

The carriages are attached to base 32 with load pins 52 which extend through carriage lugs 50 and corresponding attachment lugs 55 which extend upward from the base. As shown in FIGS. 13 and 14 attachment lugs 55 are slidably mounted to base 32. Base 32 is mounted to superstructure 22, and has an opening 181 defined therein for tubing 18 to pass therethrough. Base 56 of lugs 55 are slidably received in tracks 186, which are rigidly attached to base 32. The carriages are thus slidable toward and away from each other to accommodate various tubing sizes.

As better seen in FIG. 2, lines designated by the numerals 180 and 182 depict lines which run through the centers 113 and 119 of the gripper chain drive and idler sprockets. The apparatus 10 has a longitudinal central axis 184. Longitudinal central axis 184 is colinear with longitudinal central axis 17 of tubing 18 as it passes downward through the apparatus. Centers 53 of loading pins 52 preferably are positioned to the outside of the center lines 180 and 182.

The means for moving 60 comprises a plurality of, and preferably four, hydraulic actuator cylinders 183. The invention may include upper cylinders 185 having a longitudinal central axis 187, and lower cylinders 188 having longitudinal central axis 189. Actuator mounting plates 190 and 192 having clevis lugs 191 and 193 respectively extending therefrom are rigidly mounted to the outer plates of the carriages. The ends of cylinders 188 are attached to lugs 191 and 193. Mounting plates 190 and 192 may be attached utilizing eight bolts 196 which extend through the mounting plates 190 and 192 and the outer plates of the carriage. The four innermost bolts, generally designated by the numeral 197, which attach the actuator mounting plates may also extend through side webs 156 of the linear beam to rigidly attach the linear beam to the outer plates.

The apparatus also includes upper and lower equalizer linkages 200 and 202. Linkage 200 includes a central link 204, an upper outer link 206 and a lower outer link 208.

Center link 204 is pivotally mounted to a laterally extending guide plate 210 which is rigidly attached at its ends to superstructure 22. The outer ends of the upper and lower outer links 206 and 208 are mounted to slider plate assemblies 212 and 214 as better seen in FIGS. 6, 9 and 10. Slider plate assembly 212 includes an upper slider plate 216 and a lower slider plate 218. Upper and lower slider plates 216 and 218 are mounted to the carriage utilizing fasteners 220. Bearings 222 are mounted on fasteners 220 between upper and lower slider plates 216 and 218 and engage an inner side 224 of guide plate 210. Slider plate assembly 212 also includes bearings 226 which are mounted between upper and lower slider plates 216 and 218 using fasteners 228. Bearings 226 engage an outer edge 230 of guide plate 210.

Slider assembly 214 is arranged similar to slider plate assembly 212 and thus includes upper and lower slider plates 232 and 234, respectively. Upper and lower slider plates 232 and 234 are mounted to the carriage utilizing fasteners 236. Bearings 238 are mounted on fasteners 236 between upper and lower slider plates 232 and 234 and engage the inner side 224 of guide plate 210. Slider plate assembly 214 also includes bearings 240 mounted between upper and lower slider plates 232 and 234 using fasteners 242. Bearings 240 engage outer edge 230 of guide plate 210. The height of bearings 222, 226, 238 and 240 are substantially identical and is such that there is clearance between the slider plates and guide plates 210. Each of the bearings engage the sides of the guide plates so that when the actuators move the carriages laterally, the carriages are supported by and slide along guide plates 210. Lower equalizer linkage 202 is substantially identical to upper equalizer linkage 200 and includes the components set forth above.

Figure 9:
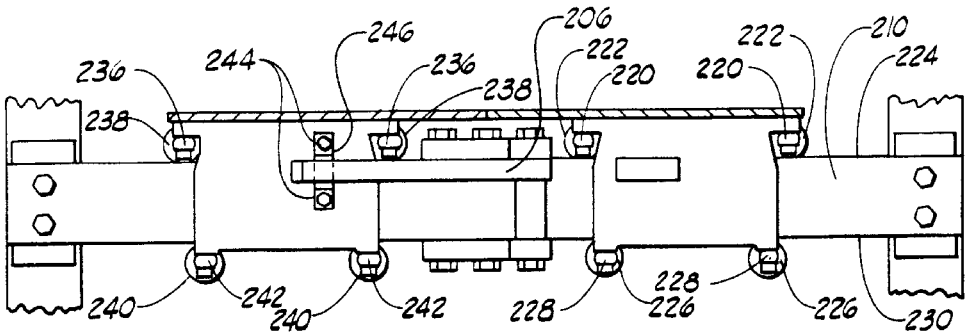
FIG. 9 shows a view taken from line 9—9 on FIG. 6.
Figure 10:
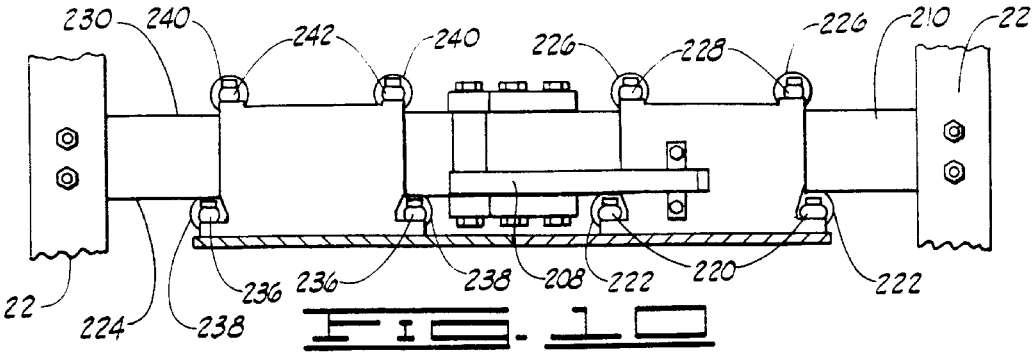
FIG. 10 shows a view taken from line 10—10 on FIG. 6.

As shown in FIGS. 9 and 10, outer link 206 of each linkage is connected to upper slider plate 232. Outer link 206 is connected utilizing a pair of fasteners 244 and a pin 246 extending therebetween. The pin 246 extends through an opening in the end of upper outer link 206. In like manner, lower outer link 208 is connected utilizing a pair of fasteners 248 with a pin 250 extending therebetween through an opening in the end of lower outer link 208. Center link 204 is connected at center line 184 of the apparatus so that when the hydraulic actuators are actuated, each carriage will move an equal distance away or toward the center line.

In operation, when it is desired that tubing be lowered, raised or suspended in a well, the hydraulic actuators will be actuated until the gripper blocks 128 engage the sides of tubing 18. The gripper chains will engage the tubing along working length 158 of the linear beams of each carriage, and a corresponding working length 252 of the chain. Thus, gripper chain 126 will first contact the tubing at upper end 157 of the working length of the linear beam, and the contact between the tubing and gripper chains 126 will break as the tubing passes lower end 159 of the working length. As set forth previously, a gripper chain utilizing blocks of the type shown in U.S. Pat. No. 5,094,340 to Avakov is preferably included. Referring to FIGS. 17 and 17A, the gripper chains may thus be comprised of outer links 300 and gripper blocks 128. The outer links and the gripper blocks are connected to form an endless chain utilizing linking pins 302 which extend through the outer links and the gripper blocks.

When the tubing is engaged by the gripper blocks, the hydraulic actuators will cause the chains to apply a uniform lateral load to the tubing. The load will be applied along the working length 158 of the pressure beam, and the corresponding working length 252 of the gripper chain, where the gripper chain engages the tubing. As the tubing is lowered into a pressurized wellbore, pressure in the well will tend to try to force the tubing upward. At some point, the weight of the tubing will overcome the load applied by the pressure in the wellbore. At that point, the tubing will apply a downward vertical, or hoisting load 254 to the gripper blocks. The vertical load 254 is applied to the chains of both carriages, so that one-half of the total vertical load is applied to each gripper chain. As shown in the schematic shown in FIG. 18, the load applied to each chain is designated by the numeral 255, and, in the embodiment shown would be applied at contact points 121, 121*a*, 123 and 123*a*.

In a typical prior art coiled tubing injector apparatus, the vertical load applied to each chain is reacted primarily by the gripper blocks 128 located at and toward the lower end 159 of the working length. The load is thus concentrated in the linking pins 302 which connect the gripper blocks at the lower end of the working length. The reason for this is that the lateral load applied by the hydraulic actuators is uniformly distributed along the working length during injecting, retracting and suspending operations. The uniform lateral load is schematically shown in FIG. 18 and is generally designated by the numeral 320. However, with the present invention, the lateral load applied to the tubing does not stay uniform once the weight of the tubing overcomes the load created by the pressure in the well. As shown in FIG. 18, the centers 53 of load pins 52 are offset from lines 125 and 127 which are drawn through contact points 121 and 121*a*, and contact points 123 and 123*a* respectively. The offset between lines 125 and 127 and the corresponding centers 53 of load pins 52 is generally designated by the numeral 260. Thus, contact points 121 and 121*a* are offset a distance 260 from the center 53 of the load pin 52 of the corresponding carriage. Likewise, contact points 123 and 123*a* are offset a distance 260 from the center 53 of the load pin 52 of the corresponding carriage. As set forth previously, the load 255 applied to each gripper chain is applied at the contact points on the gripper blocks. The load is thus applied to each chain at a distance equivalent to offset 260 from the centers 53 of the load pins. Because each carriage has its own independent load pin, and because the load pin is offset from the contact points where the vertical load 255 is applied, the vertical load applied by the tubing to the gripper blocks causes a moment around each load pin 52. That moment causes an increased lateral load along the working length of each gripper chain. The moment is reacted so that the lateral load along the working length of the gripper chain is no longer uniform, but is higher at the top than at the bottom. The lateral load will gradually decrease until it reaches its lowest magnitude at the bottom of the working length of the chain as schematically shown in FIG. 18 and generally designated by the numeral 322.

Because the lateral load is increased at the top of the working length, the vertical load 255 applied by the tubing to each chain will be distributed upward along the working length of the gripper chain and will be carried by all of the gripper blocks 128 and linking pins 302 between the upper and lower ends 157 and 159 of the working length 158 rather than being carried primarily by the linking pins at the lower end of the working length. Thus, by providing for lateral offset 260 between the load pin of each independent carriage and the point of load application to the chain, the hoisting load can be distributed among the gripper blocks 128 and the corresponding linking pins 302 located along the operating or working length of the linear beam. This reduces the load on the linking pins at the lower end of the working length and increases the chain life.

The offset 260 should not exceed "a" which can be defined using the equation set forth below $$a < 2\left(e + 2c + \left(\frac{bxf}{2}\right)\right)$$

In the equation, a is the offset 260, e is a distance 262 between the centers 185 and 189 of the upper and lower hydraulic gripper cylinders which apply the gripping force, c is the distance 264 from the center 185 of the upper gripper cylinder to the upper end 157 of the working length of the linear beam which is the point at which the chains first engage the tubing, and b is the distance 266 from lower surface 58 of the base of attachment lug 55 to upper end 157 of the working length. "f" in the equation is the friction coefficient between the base 56 of attachment lug 55 and track 186. When a steel material is used for both the lug 55 and the track, f will typically be about 0.10, assuming proper lubrication.

As will be recognized by those in the art, the contact point between the tubing and the gripper block will vary depending on the size of the tubing, and the type of gripper block used. Thus, the actual offset 260 or distance a is not fixed.

To insure that the offset 260 does not exceed the desired magnitude, an offset 261 from the face 129 of a gripper block 128 to the center 53 of the corresponding load pin should not exceed $a_1$ which is defined using the equation $$a_1 < 2\left(e + 2c + \left(\frac{bxf}{2}\right)\right)$$

where e, c, b and f are as defined above. The face 129 of the gripper blocks represents the farthest point from the centers of the load pins that the load could possibly be applied by the tubing to the chain 126. Thus, by using the outer surface 129 of the gripper block to define the offset, it can be insured that the distance a, or actual offset 260, will never exceed the maximum allowable.

In sum by positioning the load pins at a location which is offset from the point at which the load is applied to the chain on each carriage, and by insuring that that offset does not exceed the maximum as defined herein, a moment will be created by the hoisting load and will be reacted in such a way as to increase the lateral load applied by each carriage at the top of the working length of the linear beam. The result is that the vertical load is distributed and reacted by all of the gripper blocks along the working length thereof as opposed to being reacted only by the gripper blocks at a lower end of the working length.

It has been shown that the improved coiled tubing injector apparatus of this invention fulfills all objects forth hereinabove and provides distinct advantages over the known prior art. It is understood that the foregoing description of the invention and illustrative drawings which accompany the same are presented by way of explanation only and that changes may be had for those skilled in the art without departing from the true spirit of this invention.

What is claimed is:

1. A coiled tubing injector apparatus comprising:

a base;

a pair of spaced, separable carriages extending upward from said base, said carriages being positioned so that tubing may be disposed therebetween, wherein each of said spaced carriages is pivotally attached to said base; and wherein each carriage includes a gripper chain drive system having a gripper chain for engaging said tubing.

2. The coiled tubing injector apparatus of claim 1, said carriages being laterally movable with respect to said base, wherein said tubing is engaged by said gripper chains when said pair of spaced carriages are moved toward one another.

3. The coiled tubing injector apparatus of claim 1 further comprising:

each of said carriages having a carriage lug extending downward therefrom;

said base having a pair of corresponding mating attachment lugs extending upwardly therefrom, said carriages being pivotally attached to said base with a load pin extending through said carriage lugs and said corresponding attachment lugs.

4. The coiled tubing injector apparatus of claim 3, wherein each of said load pins is offset from a contact point between said gripper chain disposed in said carriage and said tubing.

5. The coiled tubing injector apparatus of claim 1 wherein each of said gripper chain drive systems comprise:

a drive sprocket rotatably mounted on the corresponding carriage;

an idler sprocket mounted on the corresponding carriage;

said gripper chain being engaged by said drive and said idler sprockets, wherein said gripper chain comprises a plurality of gripper blocks connected to form an endless chain.

6. The coiled tubing injector of claim 5 further comprising actuating means for laterally moving said carriages.

7. The tubing injector of claim 5 further comprising:

a linear beam rigidly positioned in said each of said carriages;

a roller chain system mounted on each of said linear beams for supporting said gripper chains when said gripper chains engage said tubing; and a working length defined on said linear beams, wherein said gripper chains engage said tubing along said working length.

8. The tubing injector of claim 7 further comprising actuating means for moving said carriages laterally, wherein a lateral load is applied to said tubing by said gripper chains along said working length of said linear beam when said actuating means move said carriages toward one another so that said gripper chains engage said tubing, said lateral load applied by said gripper chains to said tubing as a result of said actuating means moving said carriages being substantially uniform along said working length.

9. The coiled tubing injector apparatus of claim 8 wherein an additional lateral load is applied at a top of said working length when a downward vertical load is applied to said gripper chains so that the lateral load applied to the tubing is higher at a top of said working length than at a bottom of said working length when said downward vertical load is applied.

10. A coiled tubing injector apparatus comprising:

a base, said base having a pair of attachment lugs extending upwardly therefrom;

a pair of separable carriages attached to and extending upwardly from said attachment lugs, said carriages being spaced so that coiled tubing will pass therebetween; and means disposed in each said carriage for engaging said coiled tubing passing therebetween, wherein each of said carriages is pivotally attached to an attachment lug.

11. The coiled tubing injector apparatus of claim 10 further comprising a carriage lug defined at a lower end of each of said carriages, and a load pin extending through said carriage lugs and said corresponding attachment lugs to pivotally attach to said carriages to said base.

12. The coiled tubing injector apparatus of claim 10 wherein said means for engaging comprises a gripper chain drive system disposed in each of said carriages, said gripper chain drive system including an endless gripper chain, said gripper chain comprising a plurality of gripper blocks.

13. The coiled tubing injector of claim 12 further comprising:

a carriage lug extending downwardly at a lower end of each of said carriages; and a load pin extending through said carriage lugs and corresponding attachment lugs, wherein each said load pin is offset from a contact point defined between said gripper chain disposed in said carriage and said tubing so that a downward force applied by said tubing to said gripper chains causes a moment around each load pin.

14. The coiled tubing injector apparatus of claim 12 further comprising actuating means for moving said carriages, said carriages being movable laterally relative to said base and each other, wherein said gripper chain will engage said tubing along a working length of said gripper chain when said carriages are moved toward one another.

15. The coiled tubing injector apparatus of claim 10 wherein said attachment lugs are slidably attached to said base, so that said carriages are movable with respect to said base.

16. The coiled tubing injector of claim 10 further comprising actuating means for moving said spaced carriages laterally toward and away from each other.

17. The coiled tubing injector of claim 16 further comprising an equalizer linkage, so that said carriages move an equal distance when said actuating means is actuated.

18. A coiled tubing injector apparatus comprising:

a base, a pair of separable carriages, each attached to said base at an attachment point and each having a gripper chain disposed therein for engaging a coiled tubing, said carriages being attached at said attachment points so that a downward load applied by said tubing to said gripper chains causes a moment around each attachment point, the moment being reacted such that a lateral load is applied to said coiled tubing along a working length of said gripper chains, said lateral load being higher at an upper end of said working length than at a lower end thereof.

19. The coiled tubing injector apparatus of claim 18 wherein said carriages are attached to said base at said attachment point with a load pin, a center of said load pin being offset from a contact point between said gripper chain and said coiled tubing.

20. The coiled tubing injector of claim 18, wherein each said carriage and corresponding load pin is movable laterally with respect to said base.

21. The apparatus of claim 18, wherein said carriage is pivotally attached to said base.

* * * * *